US005517179A

United States Patent [19]

Charlot, Jr.

[11] Patent Number: 5,517,179

[45] Date of Patent: May 14, 1996

[54] SIGNAL-POWERED FREQUENCY-DIVIDING TRANSPONDER

[75] Inventor: Lincoln H. Charlot, Jr., St. Petersburg, Fla.

[73] Assignee: XLINK Enterprises, Inc., St. Petersburg, Fla.

[21] Appl. No.: 443,477

[22] Filed: May 18, 1995

[51] Int. Cl.[6] ..... G08B 13/187

[52] U.S. Cl. ..... 340/572; 363/157; 363/158; 363/163

[58] Field of Search ..... 340/572; 363/157, 363/158, 159, 163

[56] References Cited

U.S. PATENT DOCUMENTS

| | | | |
|---|---|---|---|
| 3,836,842 | 9/1974 | Zimmermann et al. | 340/572 |
| 3,911,534 | 10/1975 | Martens et al. | 340/572 |
| 4,314,373 | 2/1987 | Sellers | 455/73 |
| 4,481,428 | 11/1984 | Charlot, Jr. | 327/118 |
| 4,670,740 | 6/1987 | Herman et al. | 340/572 |
| 5,065,137 | 11/1991 | Herman | 340/572 |
| 5,065,138 | 11/1991 | Lian et al. | 340/572 |
| 5,241,298 | 8/1993 | Lian et al. | 340/572 |

*Primary Examiner*—Glen Swann
*Attorney, Agent, or Firm*—Edward W. Callan

[57] ABSTRACT

A batteryless, portable frequency divider, such as used in presence detection systems for article surveillance or as used for article-location determination, includes a series LC resonant circuit connected directed across a parallel LC resonant circuit. One circuit is resonant at a first frequency and the other circuit is resonant at a second frequency that is a plural-integer-divided quotient of the first frequency. In one class of embodiments, either or both of the series and parallel resonant circuits includes a variable capacitance element, such as a varactor, in which the capacitance varies in accordance with the voltage across the variable capacitance element. The variation of the capacitance of the variable capacitance element in response to variations in energy in the higher-frequency resonant circuit resulting from receipt electromagnetic radiation at the first frequency causes the lower-frequency resonant circuit to transmit electromagnetic radiation at the second frequency. In another class of embodiments, the parallel circuit is resonant at the higher first frequency and the series circuit is resonant at the frequency-divided second frequency; the frequency divider includes a three-terminal semiconductor switching device having a control terminal, a reference terminal, and a controlled terminal, which is connected directly across both resonant circuits and between the inductance and the capacitance of the series resonant circuit and which switches on and off in response to variations in energy in the parallel resonant circuit resulting from the parallel resonant circuit receiving electromagnetic radiation at the first frequency to cause the series resonant circuit to transmit electromagnetic radiation at the second frequency.

20 Claims, 2 Drawing Sheets

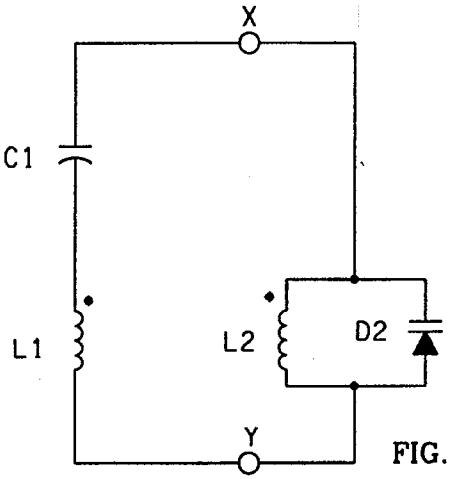
FIG. 1
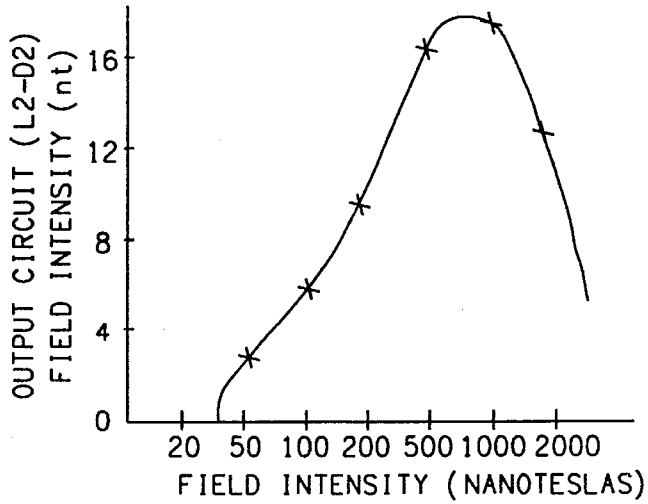
FIG. 2 INPUT CIRCUIT (L1-C1)
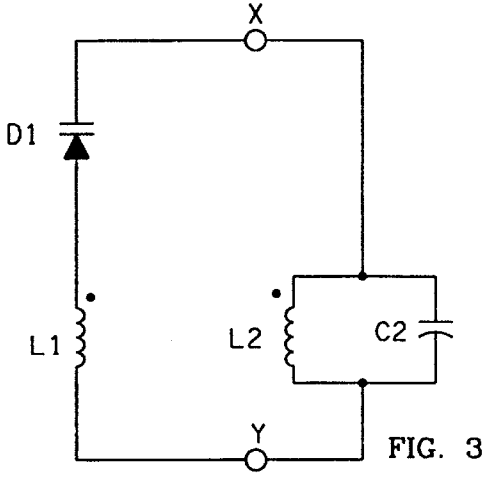
FIG. 3
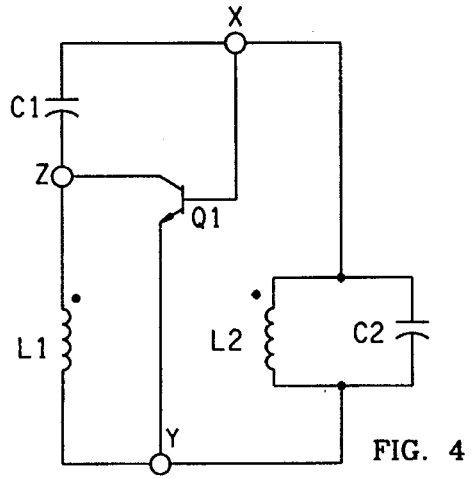
FIG. 4
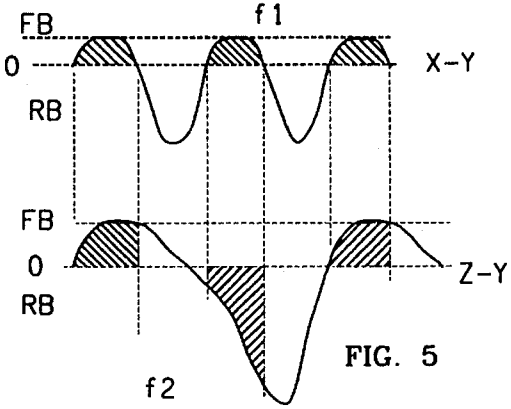
FIG. 5
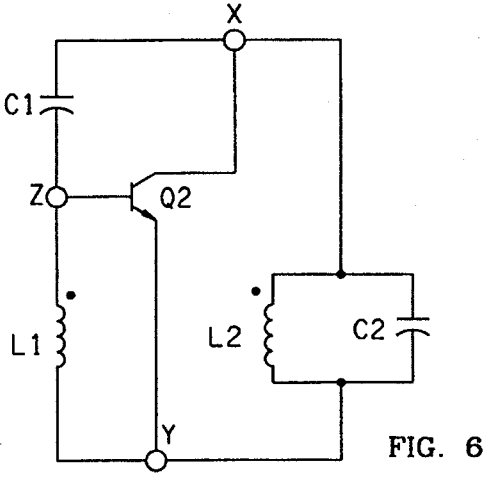
FIG. 6

SIGNAL-POWERED FREQUENCY-DIVIDING TRANSPONDER

BACKGROUND OF THE INVENTION

The present invention generally pertains to batteryless, portable frequency dividers such as are used as miniature signal-powered transponders in presence detection systems. Presence detection systems are useful for article surveillance and article-location determination. Batteryless, portable frequency dividers are described in U.S. Pat. No. 5,241,298 to Ming R. Lian and Fred W. Herman, U.S. Pat. No. 4,481,428 to Lincoln H. Chariot, Jr., U.S. Pat. No. 4,670,740 to Fred W. Herman and Lincoln H. Chariot, Jr. and U.S. Pat. No. 4,314,373 to Robert W. Sellers.

The frequency dividers described in U.S. Pat. Nos. 5,241,298; 4,481,428 and 4,314,373 each comprises a first parallel resonant circuit including an inductance and a capacitance that is resonant at a first frequency for receiving electromagnetic radiation at a first frequency and a second parallel resonant circuit including an inductance and a capacitance that is resonant at a second frequency that is one-half the first frequency for transmitting electromagnetic radiation at the second frequency.

In the frequency divider described in U.S. Pat. No. 5,241,298, the capacitance of one or both of the resonant circuits is a variable capacitance element in which the capacitance varies in accordance with the voltage across the variable capacitance element; and variation of the capacitance of the variable capacitance element in response to variations in energy in the first resonant circuit resulting from the first resonant circuit receiving electromagnetic radiation at the first frequency causes the second resonant circuit to transmit electromagnetic radiation at the second frequency The two resonant circuits are magnetically coupled to one another or electrically connected through an electrical coupling element, such as an additional coupling capacitor or a semiconductor element.

In the frequency divider described in U.S. Pat. No. 4,481,428 the two resonant circuits are electrically connected to one another by a semiconductor switching device that couples the first resonant circuit to the second resonant circuit to cause the second resonant circuit to transmit electromagnetic radiation at the second frequency in response to receipt of radiation at the first frequency. The resonant circuit inductances contain both in-phase and out-of-phase currents and the inductance cods are disposed perpendicular to each other so that the magnetic fields of the two coils are orthogonal in order to avoid cancellation of fields and a resulting decrease in efficiency.

In the frequency divider described in U.S. Pat. No. 4,314,373, the resonant circuits are coupled to one another through a variable capacitance element, such as a varactor diode, to cause the second resonant circuit to transmit electromagnetic radiation at the second frequency in response to receipt of electromagnetic radiation by the first resonant circuit at the first frequency.

The frequency divider described in U.S. Pat. No. 4,670,740 consists of a parallel resonant circuit including an inductance and variable capacitance device that is resonant at a second frequency that is one-half a first frequency to cause the circuit to transmit electromagnetic radiation at the second frequency in response to receipt of electromagnetic radiation at the first frequency.

SUMMARY OF THE INVENTION

The present invention provides a batteryless, portable frequency divider, comprising a first resonant circuit including an inductance and a capacitance that is resonant at a first frequency for receiving electromagnetic radiation at a first frequency; and a second resonant circuit including an inductance and a capacitance that is resonant at a second frequency that is 1/n the first frequency for transmitting electromagnetic energy at the second frequency, wherein "n" is an integer greater than one; wherein one of the resonant circuits is a series resonant circuit and the other of the resonant circuits is a parallel resonant circuit; wherein the one resonant circuit is connected directly across the other resonant circuit: and wherein the frequency divider includes an element for causing the second resonant circuit to transmit electromagnetic radiation at the second frequency in response to variations in energy in the first resonant circuit resulting from the first resonant circuits receiving electromagnetic radiation at the first frequency.

The frequency divider of the present invention is highly efficient so as to be detectable over a large range and is stable in sensitivity (or detection range) due to the direct connection of the two resonant circuits. The direct connection of the resonant circuits also reduces the effect of magnetic coupling of the circuits and allows use of a common ferrite core for the inductance coils of the two circuits.

Highest efficiency is achieved when "n" is two. "n" may be greater than two, but frequency dividers having division ratios greater than two suffer from excessive conversion losses and division has not been detected when "n" is greater than ten.

Because the first resonant circuit is connected directly across the second resonant circuit, one of the two resonant circuits must be a series resonant circuit in order to define two discrete resonant circuits.

In one class of preferred embodiments, the capacitance of one or both of the resonant circuits is a variable capacitance element in which the capacitance varies in accordance with the voltage across the variable capacitance element; and variation of the capacitance of the variable capacitance element in response to variations in energy in the first resonant circuit resulting from the first resonant circuit's receiving electromagnetic radiation at the first frequency causes the second resonant circuit to transmit electromagnetic radiation at the second frequency.

In another class of preferred embodiments, the frequency divider includes a three-terminal semiconductor switching device having a control terminal, a reference terminal, and a controlled terminal; the first resonant circuit is a parallel resonant circuit and the second resonant circuit is a series resonant circuit: and the semiconductor switching device is connected directly across both resonant circuits and between the inductance and the capacitance of the series resonant circuit and switches on and off in response to variations in energy in the parallel resonant circuit resulting from the parallel resonant circuit's receiving electromagnetic radiation at the first frequency to cause the series resonant circuit to transmit electromagnetic radiation at the second frequency.

The present invention further provides a tag for attachment to an article to be detected within a surveillance zone of an electronic article surveillance system, wherein the tag includes the frequency divider of the present invention as a transponder for detecting electromagnetic radiation of a first predetermined frequency and responding to said detection by transmitting electromagnetic radiation of a second predetermined frequency that is a plural-integer-divided quotient of the first predetermined frequency; a container for housing the transponder and means for use in attaching the container to the article to be detected.

The present invention also provides a tag for attachment to a buried article to enable the buried article to be located by detecting the presence of the tag, wherein the tag includes the frequency divider of the present invention as a transponder for detecting electromagnetic radiation of a first predetermined frequency and responding to said detection by transmitting electromagnetic radiation of a second predetermined frequency that is a plural-integer-divided quotient of the first predetermined frequency; and a sealed container housing the transponder to protect the transponder from moisture.

Additional features of the present invention are described in relation to the detailed description of the preferred embodiments.

BRIEF DESCRIPTION OF THE DRAWING

FIG. 1 is a schematic circuit diagram of one preferred embodiment of a frequency divider according to the present invention.

FIG. 2 is a graph showing the field intensity of electromagnetic radiation transmitted by the second resonant (output) circuit in relation to the field intensity of electromagnetic radiation received by the first resonant (input) circuit in the frequency divider of FIG. 1.

FIG. 3 is a schematic circuit diagram of another preferred embodiment of a frequency divider according to the present invention FIG. 4 is a schematic circuit diagram of a further preferred embodiment of a frequency divider according to the present invention.

FIG. 5 shows waveforms of the voltages at the terminals of the frequency divider of FIG. 4 to which the base and the collector of the transistor Q1 are respectively connected with respect to the voltage at the terminal to which the emitter of the transistor Q1 is connected.

FIG. 6 is a schematic circuit diagram of still another preferred embodiment of a frequency divider according to the present invention.

DETAILED DESCRIPTION OF THE PREFERRED EMBODIMENTS

Figure 7:
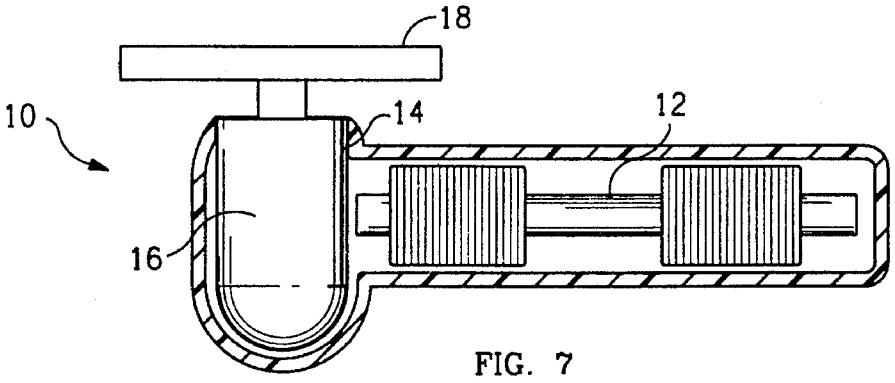
FIG. 7 is plan view of a tag containing a frequency-dividing transponder for use in an electronic article surveillance system, wherein portions of the tag are broken away to show the casing of a clutch mechanism and the inductance components of the frequency dividing transponder.

In one preferred embodiment, as shown in FIG. 1, the frequency divider includes a series resonant circuit including an inductance L1 and a capacitance C1 and a parallel resonant circuit including an inductance L2 and a varactor D2. The varactor D2 is a variable capacitance element in which the capacitance varies in accordance with the voltage across the variable capacitance element.

The series resonant circuit L1–C1 is connected directly across the parallel resonant circuit L2–D2 at the terminals X and Y.

In one embodiment of the frequency divider of FIG. 1, the values of the respective components of the series resonant circuit L1–C1 and the parallel resonant circuit L2–D2 are selected so that the series resonant circuit L1–C1 is resonant at a first frequency for receiving electromagnetic radiation at a first frequency and the parallel resonant circuit L2–D2 is resonant at a second frequency that is one-half the first frequency for transmitting electromagnetic energy at the second frequency. The variation of the capacitance of the varactor D2 in response to variations in energy in the series resonant circuit L1–C1 resulting from the series resonant circuit L1–C1 receiving electromagnetic radiation at the first frequency causes the parallel resonant circuit L2–D2 to transmit electromagnetic radiation at the second frequency.

The component values required for resonance of the series resonant circuit L1–C1 and the parallel resonant circuit L2–D2 may not be chosen independently from each other due to the direct interconnection of the series and parallel resonant circuits, but must be chosen as a set of values simultaneously selected for all four components. In an embodiment of the frequency divider of FIG. 1, in which the resonant frequency of the series resonant circuit L1–C1 is 132 kHz. and the resonant frequency of the parallel resonant circuit L2–D2 is 66 kHz., the respective values of the components are as follows: L1=2.2 mH.; C1=1,000 pf.; L2=2.2 mH. and the varactor D2 is a Motorola model MV 1407, or equivalent, having a zero-voltage capacitance of 1,700 pf.

FIG. 2 shows the field intensity of electromagnetic radiation transmitted by the parallel resonant (output) circuit L2–D2, in nano-Teslas, in relation to the field intensity of electromagnetic radiation received by the series resonant (input) circuit L1–C1, also in nano-Teslas, in the frequency divider of FIG. 1.

In an alternative embodiment of the frequency divider of FIG. 1, the values of the respective components of the series resonant circuit L1–C1 and the parallel resonant circuit L2–D2 are selected so that the parallel resonant circuit L2–D2 is resonant at a first frequency for receiving electromagnetic radiation at a first frequency and the series resonant circuit L1–C1 is resonant at a second frequency that is one-half the first frequency for transmitting electromagnetic energy at the second frequency. The variation of the capacitance of the varactor D2 in response to variations in energy in the parallel resonant circuit L2–D2 resulting from the parallel resonant circuit L2–D2 receiving electromagnetic radiation at the first frequency causes the series resonant circuit L1–C1 to transmit electromagnetic radiation at the second frequency.

In another preferred embodiment, as shown in FIG. 3, the frequency divider includes a series resonant circuit including an inductance L1 and a varactor D1 and a parallel resonant circuit including an inductance L2 and a capacitance C2. The varactor D1 is a variable capacitance element in which the capacitance varies in accordance with the voltage across the variable capacitance element.

The series resonant circuit L1–D1 is connected directly across the parallel resonant circuit L2–C2 at the terminals X and Y.

In one embodiment of the frequency divider of FIG. 3, the values of the respective components of the series resonant circuit L1–D1 and the parallel resonant circuit L2–C2 are selected so that the series resonant circuit L1–D1 is resonant at a first frequency for receiving electromagnetic radiation at a first frequency and the parallel resonant circuit L2–C2 is resonant at a second frequency that is one-half the first frequency for transmitting electromagnetic energy at the second frequency. The variation of the capacitance of the varactor D1 in response to variations in energy in the series resonant circuit L1–D1 resulting from the series resonant circuit L1–D1 receiving electromagnetic radiation at the first frequency causes the parallel resonant circuit L2–C2 to transmit electromagnetic radiation at the second frequency.

The component values required for resonance of the series resonant circuit L1–D1 and the parallel resonant circuit L2–C2 may not be chosen independently from each other due to the direct interconnection of the series and parallel resonant circuits, but must be chosen as a set of values simultaneously selected for all four components. In an embodiment of the frequency divider of FIG. 3, in which the resonant frequency of the series resonant circuit L1–D1 is 132 kHz. and the resonant frequency of the parallel resonant circuit L2–C2 is 66 kHz., the respective values of the components are as follows: L1=1.2 mH.; the varactor D1 is a Motorola model MV 1407, or equivalent, having a zero-voltage capacitance of 1,700 pf.; L2=1.2 mH. and C2=3,300 pf..

In an alternative embodiment of the frequency divider of FIG. 3, the values of the respective components of the series resonant circuit L1–C1 and the parallel resonant circuit L2–D2 are selected so that the parallel resonant circuit L2–C2 is resonant at a first frequency for receiving electromagnetic radiation at a first frequency and the series resonant circuit L1–D1 is resonant at a second frequency that is one-half the first frequency for transmitting electromagnetic energy at the second frequency. The variation of the capacitance of the varactor D1 in response to variations in energy in the parallel resonant circuit L2–C2 resulting from the parallel resonant circuit L2–C2 receiving electromagnetic radiation at the first frequency causes the series resonant circuit L1–D1 to transmit electromagnetic radiation at the second frequency.

In another preferred embodiment (not shown), the frequency divider of FIG. 3 is modified by substituting a varactor having a zero-voltage capacitance of 3,300 pf. for the capacitance C2 in the parallel resonant circuit. The operation of this embodiment is as described above with reference to FIGS. 1 and 3.

In a further preferred embodiment, as shown in FIG. 4, the frequency divider includes a series resonant circuit including an inductance L1 and a capacitance C1, a parallel resonant circuit including an inductance L2 and a capacitance C2, and a semiconductor switching device, to wit: an npn bipolar transistor Q1.

The values of the respective components of the series resonant circuit L1–C1 and the parallel resonant circuit L2–C2 are selected so that the parallel resonant circuit L2–C2 is resonant at a first frequency for receiving electromagnetic radiation at a first frequency and the series resonant circuit L1–C1 is resonant at a second frequency that is one-half the first frequency for transmitting electromagnetic energy at the second frequency.

The series resonant circuit L1–C1 is connected directly across the parallel resonant circuit L2–C2 at the terminals X and Y.

The transistor Q1 is connected to series resonant circuit L1–C1 as a three-terminal semiconductor switching device so that its base functions as a control terminal, its emitter functions as a reference terminal, and its collector functions as a controlled terminal.

The transistor Q1 is connected directly across both resonant circuits L1–C1 and L2–C2 and between the inductance L1 and the capacitance C1 of the series resonant circuit with its control terminal (base) connected to a terminal X that is common to the parallel resonant circuit and the capacitance C1 of the series resonant circuit, with its reference terminal (emitter) connected to a terminal Y that is common to the parallel resonant circuit and the inductance L1 of the series resonant circuit and with its controlled terminal (collector) connected to a terminal Z which is connected between the capacitance C1 and the inductance L1 of the series resonant circuit so that the transistor Q11 switches on and off in response to variations in energy in the parallel resonant circuit L2–C2 resulting from the parallel resonant circuit L2–C2 receiving electromagnetic radiation at the first frequency to cause the series resonant circuit L1–C1 to transmit electromagnetic radiation at the second frequency.

The waveforms of the voltages at the terminals X and Z of the frequency divider of FIG. 4 to which the base and the collector of the transistor Q1 are respectively connected with respect to the voltage at the emitter-connected terminal Z are shown in FIG. 5. In these waveforms the forward-biased voltage FB is shown above the abscissa and the reverse-biased voltage RB is shown below the abscissa. The shaded portions of these waveforms show the forward-biased portion of the voltage between the control terminal X and the reference terminal Y; and both the forward-biased and the reverse-biased portions of the voltage between the controlled terminal Z and the reference terminal Y.

The inductance L1 of the series resonant circuit is shunted during alternate forward-biased half-cycles of the energy at the first frequency f1 across the parallel resonant circuit L2–C2 between the terminals X and Y. These are the first and third cycles of the X-Y waveform illustrated in FIG. 5. The controlled terminal (collector) is reverse biased with respect to the reference terminal (emitter) during alternate cycles so that no shunting then occurs, which includes the second cycle of the X-Y waveform, thereby enabling frequency division in the series resonant circuit L1–C1.

Frequency division occurs by the switching action of transistor Q1 shunting the collector-to-emitter voltage across the inductance L1 during each forward-biased portion of the voltage between the terminals Z and Y. This action causes a small field energy to be induced in the inductance L1 to start the inductance L1 ringing at its characteristic resonant frequency. In the reverse-biased portion of the voltage between the terminals Z and Y no shunting action occurs so that ringing of the series resonant circuit L1–C1 is sustained at the characteristic resonant frequency f2 of the series resonant circuit L1–C1.

The component values required for resonance of the series resonant circuit L1–C1 and the parallel resonant circuit L2–C2 may not be chosen independently from each other due to the direct interconnection of the series and parallel resonant circuits, but must be chosen as a set of values simultaneously selected for all four components. In an embodiment of the frequency divider of FIG. 4, in which the resonant frequency of the series resonant circuit L1–C1 is 66 kHz. and the resonant frequency of the parallel resonant circuit L2–C2 is 132 kHz., the respective values of the components are as follows: L1=2.5 mH.; C1=2,200 pf.; L2=0.7 nfft. and C2=2,200 pf.

In still another preferred embodiment, as shown in FIG. 6, the frequency divider includes a series resonant circuit including an inductance L1 and a capacitance C1, a parallel resonant circuit including an inductance L2 and a capacitance C2, and a semiconductor switching device, to wit: an npn bipolar transistor Q2.

The values of the respective components of the series resonant circuit L1–C1 and the parallel resonant circuit L2–C2 are selected so that the parallel resonant circuit L2–C2 is resonant at a first frequency for receiving electromagnetic radiation at a first frequency and the series resonant circuit L1–C1 is resonant at a second frequency that is one-half the first frequency for transmitting electromagnetic energy at the second frequency.

The series resonant circuit L1–C1 is connected directly across the parallel resonant circuit L2–C2 at the terminals X and Y.

The transistor Q2 is connected to series resonant circuit L1–C1 as a three-terminal semiconductor switching device so that its base functions as a control terminal, its emitter functions as a reference terminal, and its collector functions as a controlled terminal.

The transistor Q2 is connected directly across both resonant circuits L1–C1 and L2–C2 and between the inductance L1 and the capacitance C1 of the series resonant circuit with its controlled terminal (collector) connected to a terminal X that is common to the parallel resonant circuit and the capacitance C1 of the series resonant circuit, with its reference terminal (emitter) connected to a terminal Y that is common to the parallel resonant circuit and the inductance L1 of the series resonant circuit and with its control terminal (base) connected to a terminal Z between and connected to the capacitance C1 and the inductance L1 of the series resonant circuit so that the transistor Q2 switches on and off in response to variations in energy in the parallel resonant circuit L2–C2 resulting from the parallel resonant circuit L2–C2 receiving electromagnetic radiation at the first frequency to cause the series resonant circuit L1–C1 to transmit electromagnetic radiation at the second frequency.

During alternate forward-biased half-cycles of the energy at the first frequency f1, the parallel resonant circuit L2–C2 is shunted between the terminals X and Y. The control terminal (base) is reverse biased with respect to the reference terminal (emitter) during alternate cycles so that no shunting then occurs, thereby enabling frequency division in the series resonant circuit L1–C1.

The component values required for resonance of the series resonant circuit L1–C1 and the parallel resonant circuit L2–C2 may not be chosen independently from each other due to the direct interconnection of the series and parallel resonant circuits, but must be chosen as a set of values simultaneously selected for all four components. In an embodiment of the frequency divider of FIG. 6, in which the resonant frequency of the series resonant circuit L1–C1 is 66 kHz. and the resonant frequency of the parallel resonant circuit L2–C2 is 132 kHz., the respective values of the components are as follows: L1=2.5 mH.; C1=2,200 pf; L2=0.7 mH. and C2=2,200 pf..

Frequency division has not been observed in the frequency divider of FIG. 6, when the component values have been so selected that "n" is greater than four.

In all of the embodiments described herein, if the inductance L1 is magnetically coupled to the inductance L2, such coupling must be in a phase-coincidence relationship so as not to reduce the efficiency of the frequency divider.

One use of the frequency divider of the present invention is as a transponder in a tag for attachment to an article to be detected within a surveillance zone of an electronic article surveillance system. Referring to FIG. 7, a preferred embodiment of the tag 10 includes the frequency-dividing transponder 12, a container 14 for housing the transponder 12 and a clutch mechanism 16 for receiving a pin 18 in order to attach the container 12 to the article to be detected (not shown).

Because of its high efficiency, the frequency divider of the present invention also is particularly useful as a transponder in a tag for attachment to a buried article, such as a conduit, to enable the buried article to be located by detecting the presence of such article. It is preferable to determine the location of buried conduits, such as are used for transporting gas, water or other fluids, or such as contain electrical wiring or fiber-optic cables for various utilities and communications services, before digging in the area of such conduits. Accordingly a preferred embodiment of the tag includes a device for attaching the container to a conduit.

Figure 8:
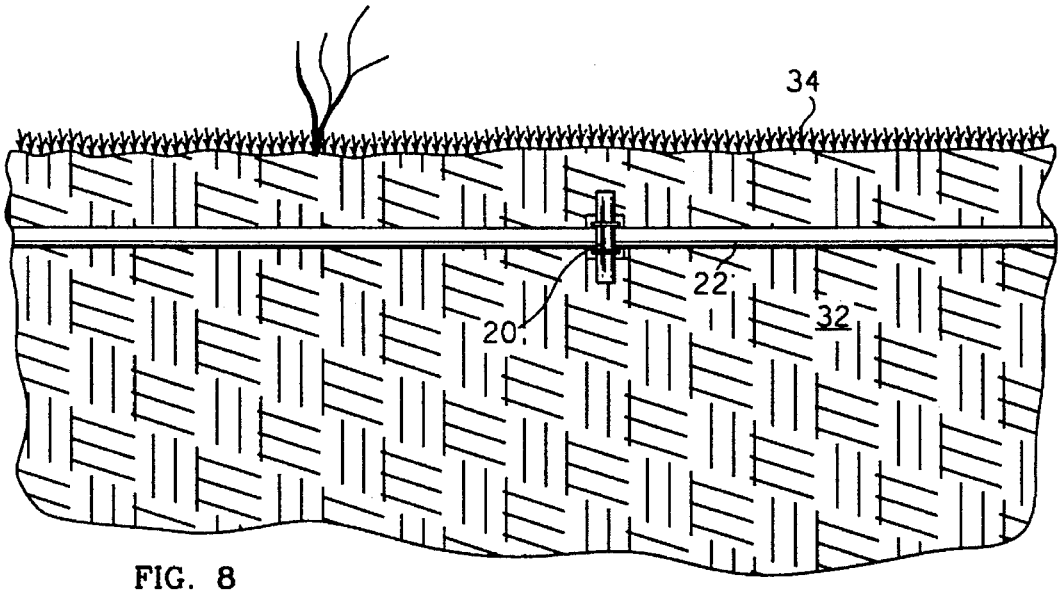
FIG. 8 is a sectional view illustrating a tag containing a frequency-dividing transponder attached to a buried conduit.
Figure 8A:
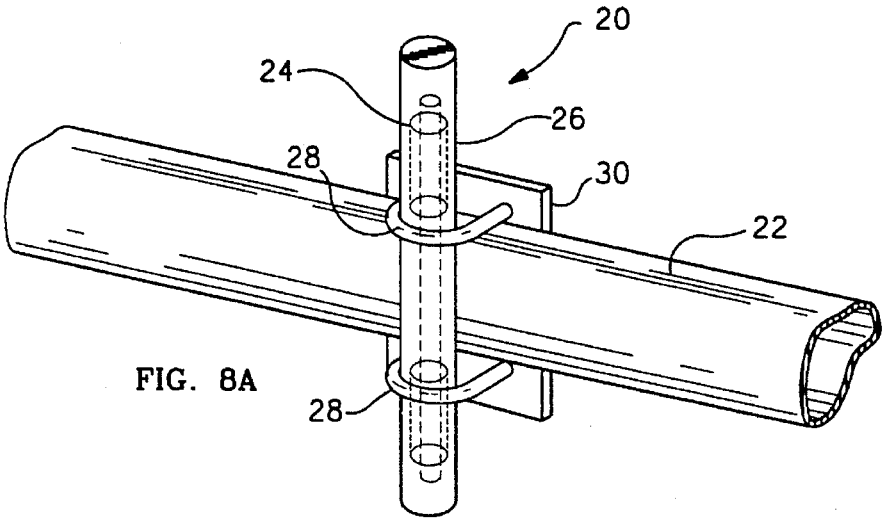
FIG. 8A is an enlarged view of the tag shown in FIG. 8, with the transponder contained therein being shown with dashed lines.

Referring to FIGS. 8 and 8A, a preferred embodiment of a tag 20 for use in locating a buried conduit 22 includes the frequency-dividing transponder 24, a sealed cylindrical container 26 housing the transponder 24 to protect the transponder 24 from moisture and U-bolts 28 and a plate 30 for attaching the container 26 to a conduit 22 that is buried in soil 32 beneath the ground surface 34. The tag 20 is attached to the conduit 22 in such a manner that the cylindrical container 26 is disposed orthogonal to the conduit 22.

While the above description contains many specificities, these should not be construed as limitations on the scope of the present invention, but rather as examples of the preferred embodiments described herein. Other variations are possible and the scope of the present invention should be determined not by the embodiments described herein but rather by the claims and their legal equivalents.

I claim:

1. A batteryless, portable frequency divider, comprising a first resonant circuit including an inductance and a capacitance that is resonant at a first frequency for receiving electromagnetic radiation at a first frequency; and a second resonant circuit including an inductance and a capacitance that is resonant at a second frequency that is 1/n the first frequency for transmitting electromagnetic energy at the second frequency, wherein "n" is an integer greater than one;

wherein one of the resonant circuits is a series resonant circuit and the other of the resonant circuits is a parallel resonant circuit;

wherein the one resonant circuit is connected directly across the other resonant circuit; and wherein the frequency divider includes an element for causing the second resonant circuit to transmit electromagnetic radiation at the second frequency in response to variations in energy in the first resonant circuit's resulting from the first resonant circuit receiving electromagnetic radiation at the first frequency.

2. A batteryless, portable frequency divider according to claim 1, wherein the capacitance of one or both of the resonant circuits is a variable capacitance element in which the capacitance varies in accordance with the voltage across the variable capacitance element; and wherein variation of the capacitance of the variable capacitance element in response to variations in energy in the first resonant circuit resulting from the first resonant circuit's receiving electromagnetic radiation at the first frequency causes the second resonant circuit to transmit electromagnetic radiation at the second frequency.

3. A frequency divider according to claim 2, wherein "n" is two.

4. A batteryless, portable frequency divider according to claim 1, comprising a three-terminal semiconductor switching device having a control terminal, a reference terminal, and a controlled terminal;

wherein the first resonant circuit is a parallel resonant circuit and the second resonant circuit is a series resonant circuit; and wherein the semiconductor switching device is connected directly across both resonant circuits and between the inductance and the capacitance of the series resonant circuit and switches on and off in response to variations in energy in the parallel resonant circuit resulting from the parallel resonant circuit's receiving electromagnetic radiation at the first frequency to cause the series resonant circuit to transmit electromagnetic radiation at the second frequency.

5. A frequency divider according to claim 4, wherein "n" is two.

6. A frequency divider according to claim 5, wherein the semiconductor switching device has its control terminal connected to a terminal common to the parallel resonant circuit and the capacitance of the series resonant circuit, its reference terminal connected to a terminal common to the parallel resonant circuit and the inductance of the series resonant circuit and its controlled terminal connected between the capacitance and the inductance of the series resonant circuit so that the inductance of the series resonant circuit is shunted during forward-biased half-cycles of the energy in the second resonant circuit, with the controlled terminal being reverse biased with respect to the reference terminal during alternate cycles so that no shunting then occurs, thereby enabling frequency division.

7. A frequency divider according to claim 5, wherein the semiconductor switching device has its controlled terminal connected to a terminal common to the parallel resonant circuit and the capacitance of the series resonant circuit, its reference terminal connected to a terminal common to the parallel resonant circuit and the inductance of the series resonant circuit and its control terminal connected between the capacitance and the inductance of the series resonant circuit so that the parallel resonant circuit is shunted during forward-biased half-cycles of the energy in the second resonant circuit, with the control terminal being reverse biased with respect to the reference terminal during alternate cycles so that no shunting then occurs, thereby enabling frequency division.

8. A tag for attachment to an article to be detected within a surveillance zone of an electronic article surveillance system, comprising a frequency-dividing transponder for detecting electromagnetic radiation of a first predetermined frequency and responding to said detection by transmitting electromagnetic radiation of a second predetermined frequency that is a plural-integer-divided quotient of the first predetermined frequency;

a container for housing the transponder and means for use in attaching the container to the article to be detected;

wherein the transponder comprises a first resonant circuit including an inductance and a capacitance that is resonant at a first frequency for receiving electromagnetic radiation at a first frequency; and a second resonant circuit including an inductance and a capacitance that is resonant at a second frequency that is 1/n the first frequency for transmitting electromagnetic energy at the second frequency, wherein "n" is an integer greater than one;

wherein one of the resonant circuits is a series resonant circuit and the other of the resonant circuits is a parallel resonant circuit;

wherein the one resonant circuit is connected directly across the other resonant circuit; and wherein the frequency-dividing transponder includes an element that is responsive to variations in energy in the first resonant circuit resulting from the first resonant circuit's receiving electromagnetic radiation at the first frequency for causing the second resonant circuit to transmit electromagnetic radiation at the second frequency.

9. A tag according to claim 8, wherein the capacitance of one or both of the resonant circuits is a variable capacitance element in which the capacitance varies in accordance with the voltage across the variable capacitance element; and wherein variation of the capacitance of the variable capacitance element in response to variations in energy in the first resonant circuit resulting from the first resonant circuit's receiving electromagnetic radiation at the first frequency causes the second resonant circuit to transmit electromagnetic radiation at the second frequency.

10. A tag according to claim 9, wherein "n" is two.

11. A tag according to claim 8, comprising a three-terminal semiconductor switching device having a control terminal a reference terminal, and a controlled terminal;

wherein the first resonant circuit is a parallel resonant circuit and the second resonant circuit is a series resonant circuit; and wherein the semiconductor switching device is connected directly across both resonant circuits and between the inductance and the capacitance of the series resonant circuit and switches on and off in response to variations in energy in the parallel resonant circuit resulting from the parallel resonant circuit's receiving electromagnetic radiation at the first frequency to cause the series resonant circuit to transmit electromagnetic radiation at the second frequency.

12. A tag according to claim 11, wherein "n" is two.

13. A tag according to claim 8, wherein the means for use in attaching the container include a clutch mechanism for receiving a pin in order to attach the container to the article to be detected.

14. A tag for attachment to a buried article to enable the buried article to be located by detecting the presence of said tag, comprising a frequency-dividing transponder for detecting electromagnetic radiation of a first predetermined frequency and responding to said detection by transmitting electromagnetic radiation of a second predetermined frequency that is a plural-integer-divided quotient of the first predetermined frequency; and a sealed container housing the transponder to protect the transponder from moisture;

wherein the transponder comprises a first resonant circuit including an inductance and a capacitance that is resonant at a first frequency for receiving electromagnetic radiation at a first frequency; and a second resonant circuit including an inductance and a capacitance that is resonant at a second frequency that is 1/n the first frequency for transmitting electromagnetic energy at the second frequency, wherein "n" is an integer greater than one;

wherein one of the resonant circuits is a series resonant circuit and the other of the resonant circuits is a parallel resonant circuit;

wherein the one resonant circuit is connected directly across the other resonant circuit; and wherein the frequency-dividing transponder includes an element that is responsive to variations in energy in the first resonant circuit resulting from the first resonant circuit's receiving electromagnetic radiation at the first frequency for causing the second resonant circuit to transmit electromagnetic radiation at the second frequency.

15. A tag according to claim 14, wherein the capacitance of one or both of the resonant circuits is a variable capacitance element in which the capacitance varies in accordance with the voltage across the variable capacitance element; and wherein variation of the capacitance of the variable capacitance element in response to variations in energy in the first resonant circuit resulting from the first resonant circuit's receiving electromagnetic radiation at the first frequency causes the second resonant circuit to transmit electromagnetic radiation at the second frequency.

16. A tag according to claim 15, wherein "n" is two.

17. A tag according to claim 14, comprising a three-terminal semiconductor switching device having a control terminal, a reference terminal, and a controlled terminal:

wherein the first resonant circuit is a parallel resonant circuit and the second resonant circuit is a series resonant circuit; and wherein the semiconductor switching device is connected directly across both resonant circuits and between the inductance and the capacitance of the series resonant circuit and switches on and off in response to variations in energy in the parallel resonant circuit resulting from the parallel resonant circuit's receiving electromagnetic radiation at the first frequency to cause the series resonant circuit to transmit electromagnetic radiation at the second frequency.

18. A tag according to claim 17, wherein "n" is two.

19. A tag according to claim 14, wherein the article is attached to a buried conduit.

20. A tag according to claim 14, further comprising means for attaching the container to a conduit.

* * * * *